United States Patent [19]

Williams

[11] 3,958,500

[45] May 25, 1976

[54] BOTTOM FORMING DEVICE FOR A BAG FORMING MACHINE

[75] Inventor: John W. Williams, Jacksonville, Fla.

[73] Assignee: Terminal Paper Bag. Co., Yulee, Fla.

[22] Filed: Oct. 25, 1974

[21] Appl. No.: 518,189

[52] U.S. Cl. ..... 93/27; 93/8 R; 93/22

[51] Int. Cl.[2] ..... B31B 1/36

[58] Field of Search ..... 93/27, 355 B, 14, 16, 93/17, 18, 21, 22, 23, 24, 25, 28, 29, 30, 8 R

[56] References Cited

UNITED STATES PATENTS

| | | | |
|---|---|---|---|
| 736,673 | 8/1903 | Bartholomew | 93/15 |
| 1,176,163 | 3/1916 | Potdevin | 93/27 X |
| 2,635,511 | 4/1953 | Potdevin | 93/23 |
| 2,691,329 | 10/1954 | Evers | 93/27 |

*Primary Examiner*—James F. Coan
*Attorney, Agent, or Firm*—Edwin T. Grimes

[57] ABSTRACT

A bottom forming device for a bag forming machine including a pair of bottom formers, each bottom former being of plate-like construction and having a vertical side portion and a horizontal top portion connected along a fold line, the horizontal top portion being characterized according to one form of the invention by an inner edge which has an elongated portion extending inwardly and rearwardly; the vertical side portion being characterized according to one form of the invention by an upper front edge which extends upwardly and rearwardly, a lower front edge which extends downwardly and rearwardly, and the upper front edge and the lower front edge meeting to form a pointed front edge; and according to one aspect of the invention the vertical side portion has a medial lower edge portion that is upwardly arcuately bowed.

8 Claims, 12 Drawing Figures

46
44
44
30
56
50
54
52
24
48
38
48
36

BOTTOM FORMING DEVICE FOR A BAG FORMING MACHINE

BACKGROUND OF THE INVENTION

This invention relates to bag making machines and more particularly to improvements in bag bottom forming apparatus for such machines.

In bag making machines to which the present invention is particularly applicable, a web of sheet material, such as paper for example, is progressively fed into the machine and formed into a tube. Gussets are formed along the opposing side edges of the tube and at preselected intervals, the tube is severed, notched and slit preparatory to bottom-forming operations upon the successive blanks. Next, the tubular bag blank is scored with a pair of parallel score lines adjacent the leading end thereof, which are included on the bottom layer as well as the upper layer of the blank. The tube is then passed to the opening cylinder and finishing drum, the finishing drum having fingers that close on the first score line on the lower or bottom layer of the tube gussets. The tube moves forward to the opening cylinder that has opening fingers that close on the first score line of the top or upper layer of the tube. These fingers open the tube to make a bottom formation, and thereafter the opening finger releases the top part of the tube from about ⅜ths inch to about ½ inch below the bottom formers. The bottom formers then complete the bottom formation and flatten it against the drum so that the upper layer is folded back on itself along the score line to thereby provide a leading flap of bottom layer extending from one of the other score lines of the upper layer. Thereafter, adhesive or paste is applied to the surfaces of the leading flap and overlying panel portions. The trailing flap is then folded along the leading score lines of the upper layer forwardly and upon the panel portions and, consequently upon the exposed adhesive. Subsequently, the leading flap is folded rearwardly along its leading score line so that it will not only adhere to the panels but to the outer surfaces of the trailing flap as well. The bag blank is thus formed into a finished bag, which is then discharged from the machine.

An object of the invention is to provide a new and improved bottom forming device which may be easily applied to existing types of bag forming machines without greatly altering the present construction thereof and which is relatively simple, compact, convenient, practical, and inexpensive.

Another object of the invention is to provide an improved bottom forming device which, before the opening cylinder fingers release the top part of the tube, the bottom formers are in contact with the open tube, thereby causing the open tube to break on the first and second score lines at the same time the bottom is formed in a rolling motion instead of a break-down motion as was effected with prior commerical machines.

Another object of the invention is to provide an improved bottom forming device which simplifies the adjustment procedure, which has complete control of the bottom formation, at all times, which increases the machine speed from about 50 to about 75 bags per minute, which avoids air traps, and which makes quality bags at a substantially lower rate of speed than heretofore, thereby reducing the wastage during start-up.

Thus, the present invention involves a novel combination of features combined in such a way as to afford a very efficient and effective solution to the difficulties encountered with the prior art, as will become apparent as the description proceeds.

In order to accomplish the desired results, this invention provides in one form thereof, a new and improved bottom forming device for a bag making machine comprising a pair of bottom formers, each bottom former being of plate-like construction and having a vertical side portion and a horizontal top portion connected along a fold line. According to one aspect of the invention, the horizontal top portion has an inner edge which has an elongated portion extending inwardly and rearwardly. According to another aspect of the invention, the vertical side portion on upper front edge which extends upwardly and rearwardly, a lower front edge which extends downwardly and rearwardly, and said upper front edge and said lower front edge meeting to form a pointed front edge. According to still another aspect of the invention, the vertical side portion has a medial lower edge portion that is upwardly arcuately bowed.

There has thus been outlined rather broadly the more important features of the invention in order that the detailed description thereof that follows may be better understood, and in order that the present contribution to the art may be better appreciated. There are, of course, additional features of the invention that will be described more fully hereinafter. Those skilled in the art will appreciate that the conception on which this disclosure is based may readily be utilized as the basis of the designing of other structures for carrying out the purposes of this invention. It is important, therefore, that this disclosure be regarded as including such equivalent construction as do not depart from the spirit and scope of the invention.

One embodiment of the invention has been chosen for purposes of illustration and description, and is shown in the accompanying drawings forming a part of the specification, wherein:

FIG. 3 is a top plan view of the bottom forming arrangement according to the invention;

Figure 1:
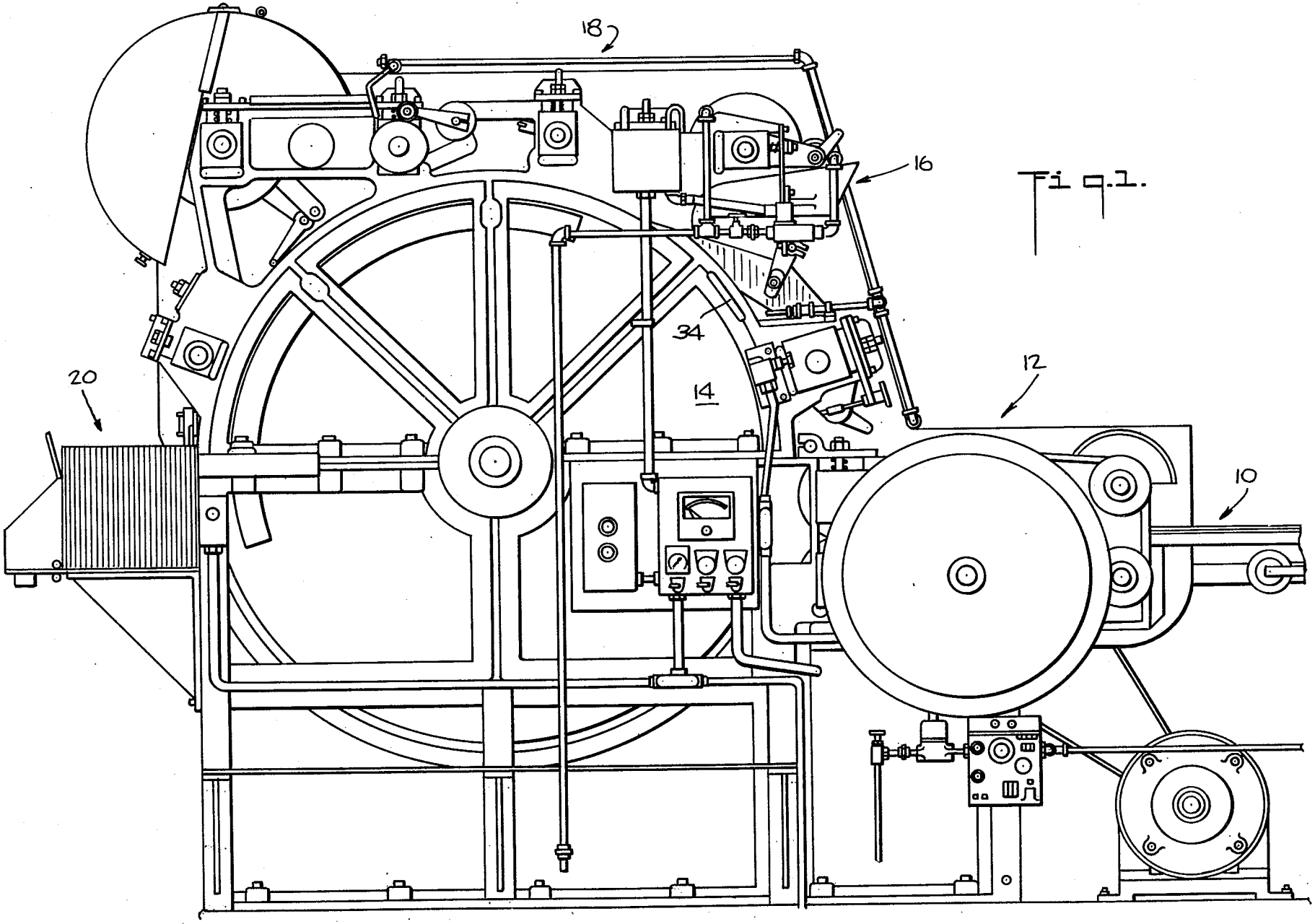
FIG. 1 is a side elevational view showing a bottom forming arrangement constructed in accordance with the concepts of this invention, mounted on a conventional bag making machine.

In the illustrated embodiment of the invention, the bag forming machine may be of any conventional type such as one having a feeding portion 10, a tube forming, slitting and scoring portion 12, and a bag finishing drum 14 around which is disposed a bottom forming and pasting portion 16, a folding and tucking portion 18 and an end stack delivery portion 20, as shown in FIG. 1.

Figure 11:
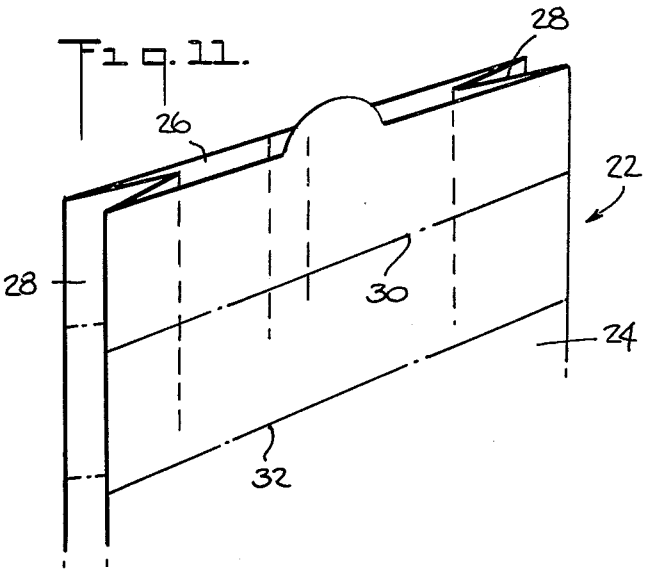
FIG. 11 is a perspective view of a tubular, gusseted bag blank prior to being operated upon by the bottom forming apparatus of the present invention.
Figure 12:
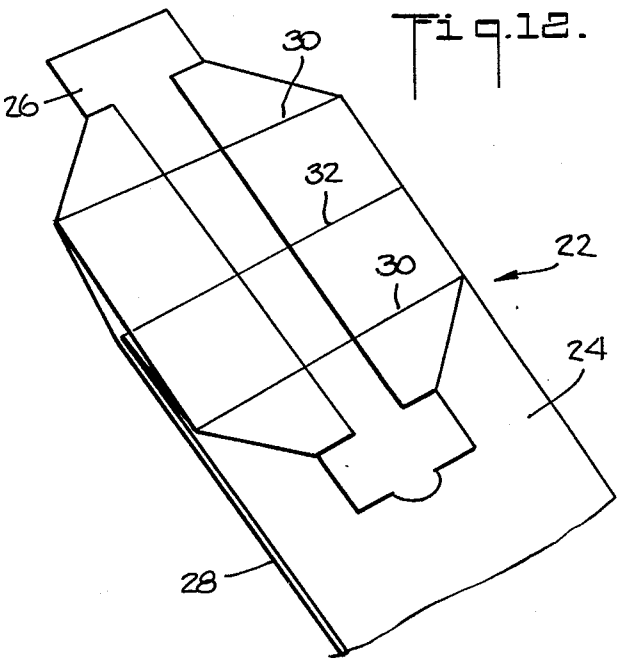
FIG. 12 is a perspective view showing the bag blank subsequent to the bottoming operation of the present invention.

As the bag tube approaches the bottom forming portion 16 of the machine, it will be in the form of a severed tube 22, as shown in FIG. 11 having a top part or upper layer 24 and a lower part or bottom layer 26 connected by gusseted edges 28. A first score line 30 and a second parallel score line 32 are provided toward the leading end of the bag blank.

The finishing drum 13 has fingers 34, FIG. 1, that close on the first score line 30 of the lower part 26 of the tube. The tube continues to move around on the finishing drum 14 in a counter-clock-wise direction, as seen in FIG. 1, until it reaches an opening cylinder 36, FIGS. 2 and 8, having an opening finger 38 that closes on the first score line 30 on the top part 24 of the tube. As the bag blank continues to move forward these fingers open the tube for a bottom formation.

Figure 9:
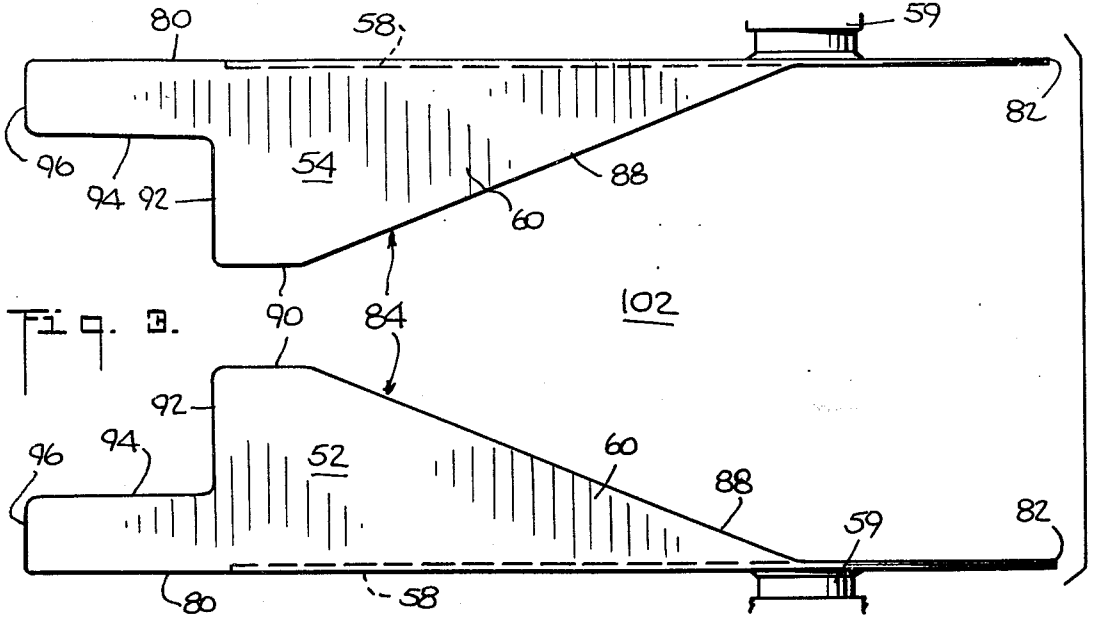
FIG. 9 is a side elevation of one bottom former member according to the prior art.
Figure 10:
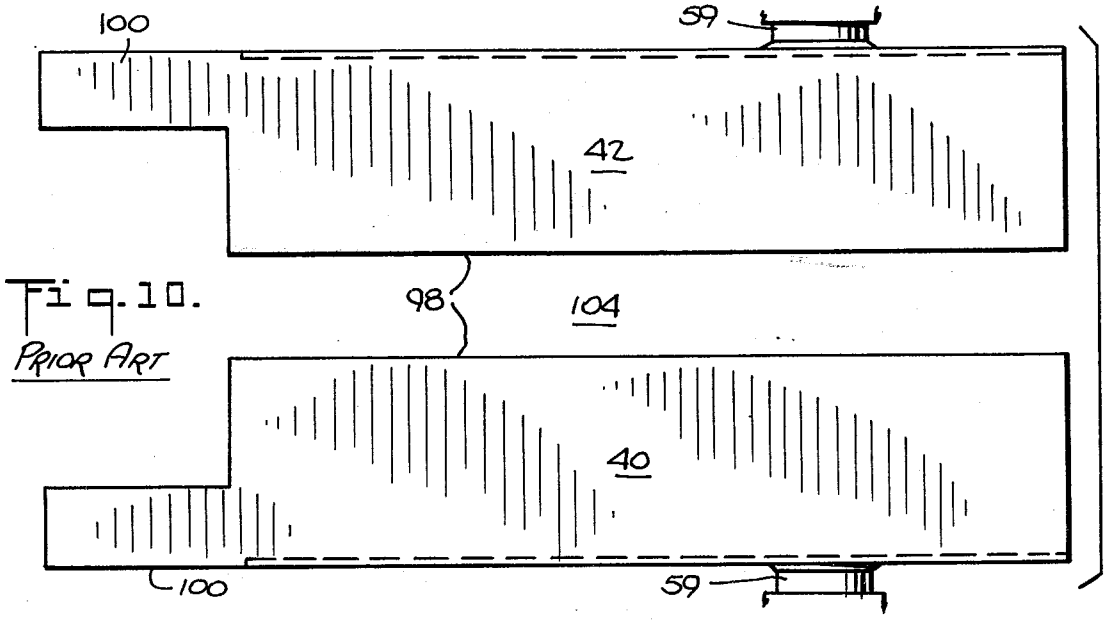
Fig. 10. PRIOR ART
FIG. 10 is a plan view of a bottom forming arrangement according to the prior art.
Figures 8, 9:
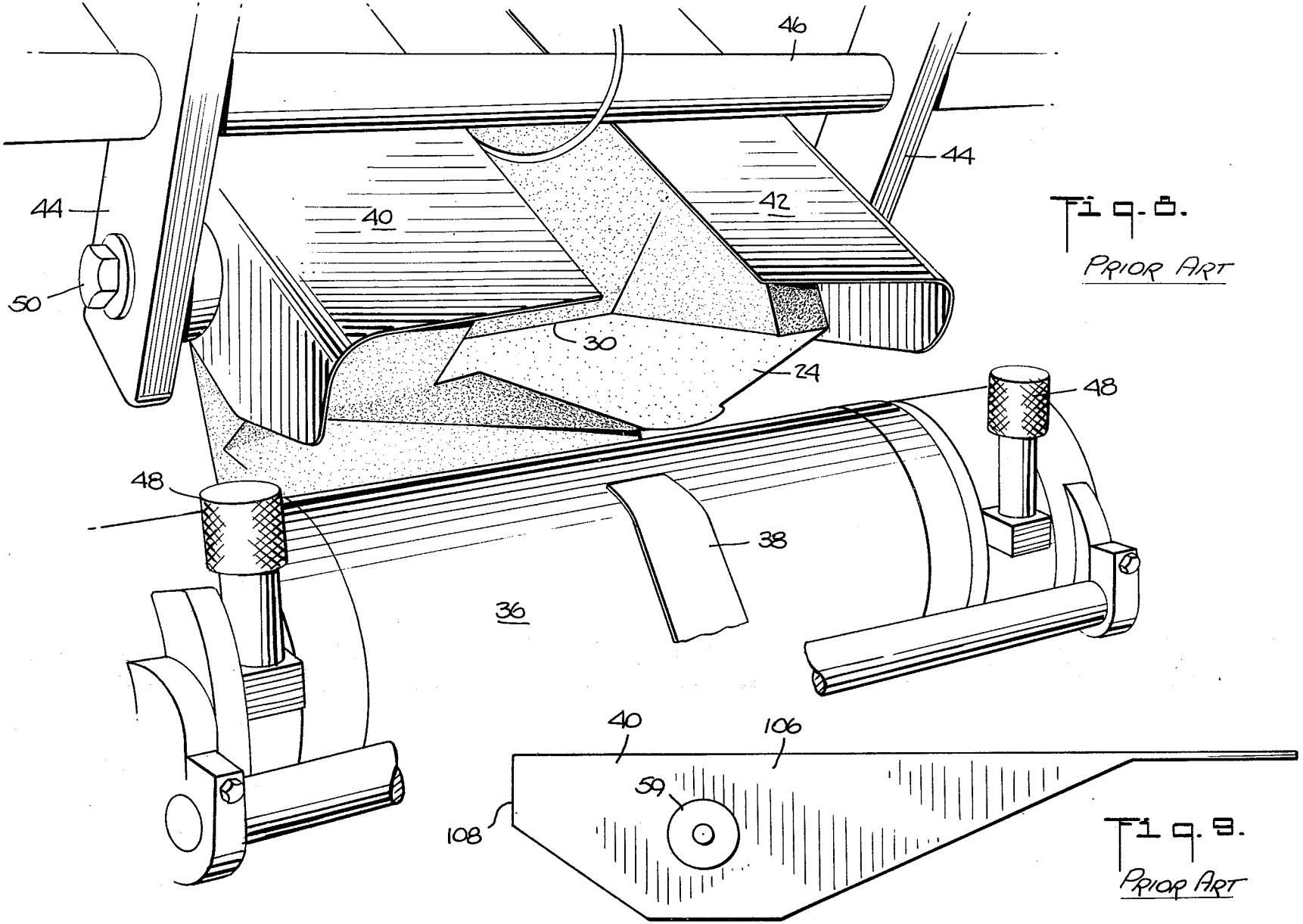
Fig. 8. Prior Art
Fig. 9. Prior Art
FIG. 8 is a perspective view of bottom forming apparatus according to the prior art.

Referring to the prior art bottom forming system, shown in FIG. 8, the opening finger 38 releases the top part 24 of the tube between about ⅜ inch and ½ inch below a pair of bottom formers 40 and 42. The bottom formers then complete the bottom formation of the bag and flatten it against the drum 14 so that the upper layer 24 is folded back on itself over the bottom layer. The contour of the prior art bottom formers is shown in FIGS. 9 and 10, as will be discussed more fully hereinafter. As seen in FIG. 8, the bottom formers are mounted on slotted brackets 44 which are carried by a rod 46 that is fastened to the machine frame. The opening cylinder 36 is provided with adjusting screws 48 for positioning same. The bottom formers can be adjusted to various positions in relation to the drum and open cylinder by virture of clamp screws 50 on the brackets 44.

Figure 2:
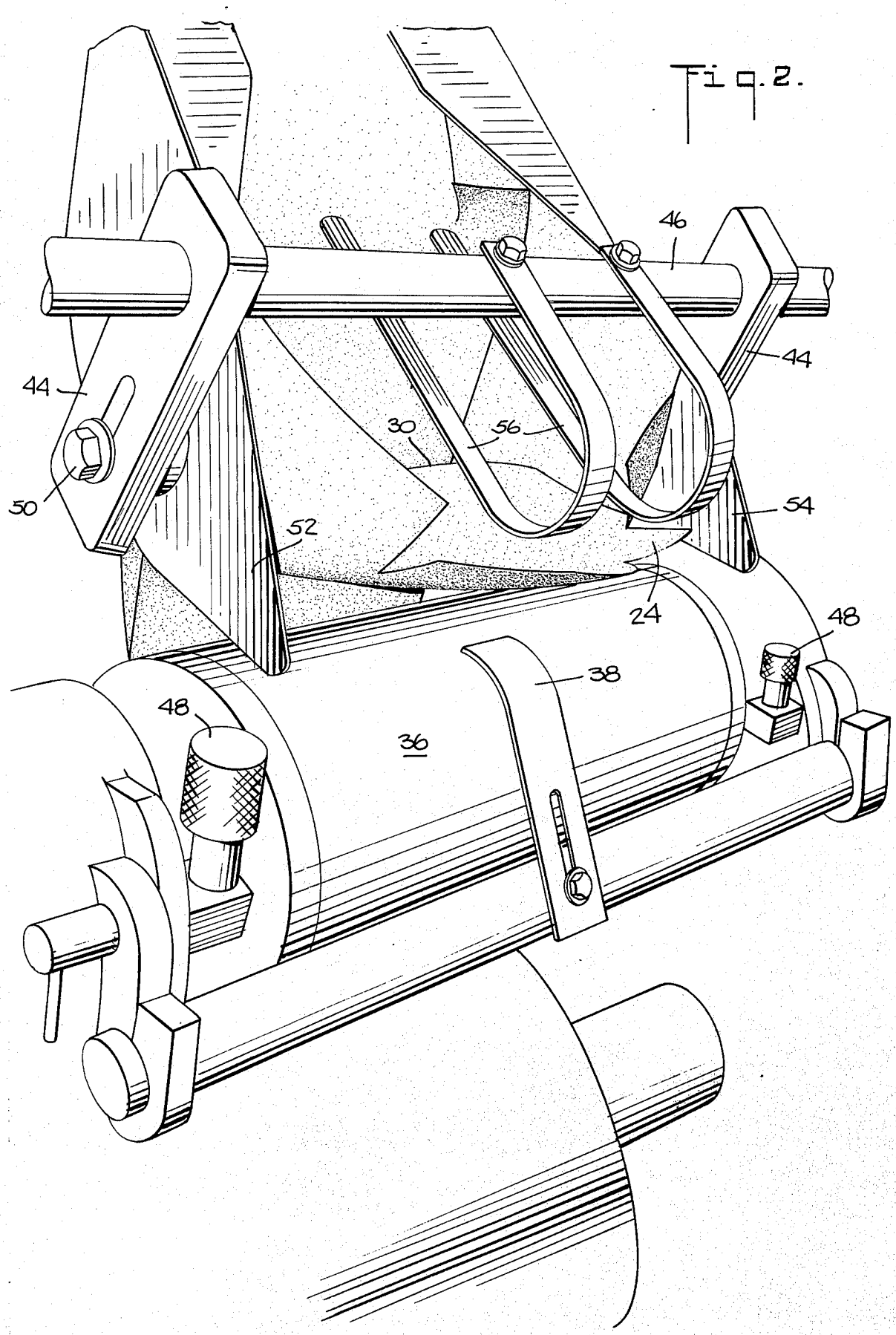
FIG. 2 is an enlarged perspective view showing details of the bottom forming arrangement of the present invention.

In the structure of the present invention, as seen in FIG. 2, a pair of bottom formers 52 and 54 are mounted on the slotted brackets 44 which are carried by the rod 46 that is fastened to the machine frame. The clamp screws 50 are provided for adjusting the bottom formers 52 and 54. The adjusting screws 48 serve to adjust the opening cylinder 36. In addition, it is desirable in some installations to provide guide fingers 56 mounted on the rod 46 for assisting in flattening the upper layer 24 as it is being folded back on itself during the bottom formation.

Figure 4:
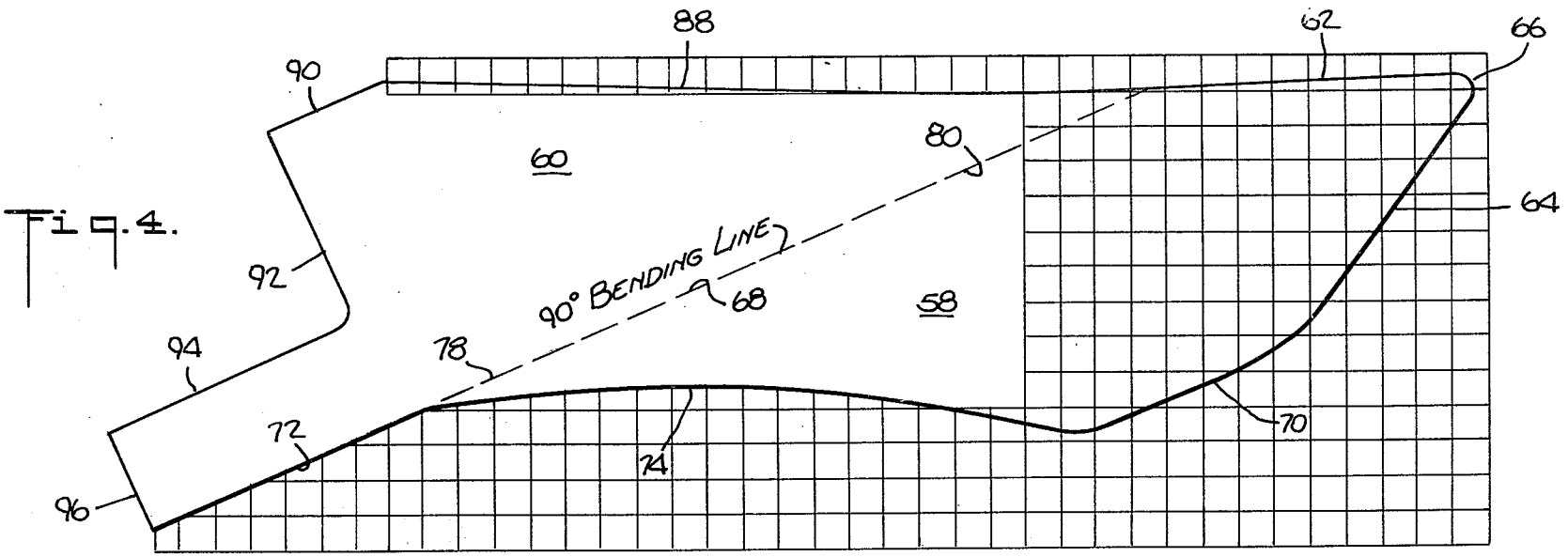
FIG. 4 is an enlarged layout view of one bottom former member according to the present invention.
Figure 5:
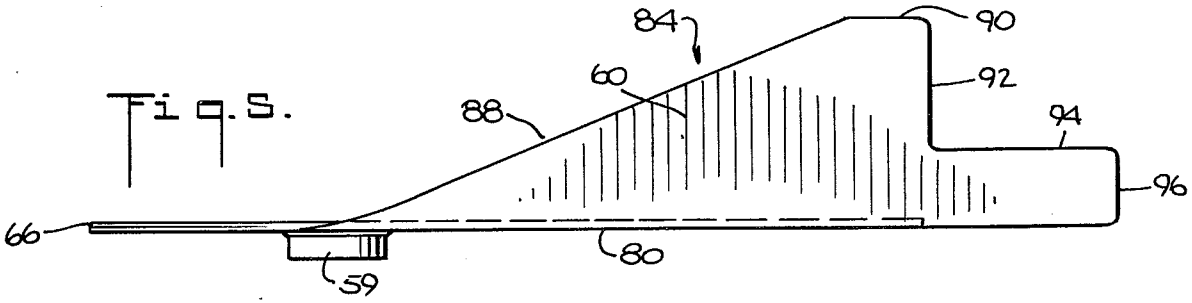
FIG. 5 is a plan view of one bottom forming member according to the invention.
Figure 6:
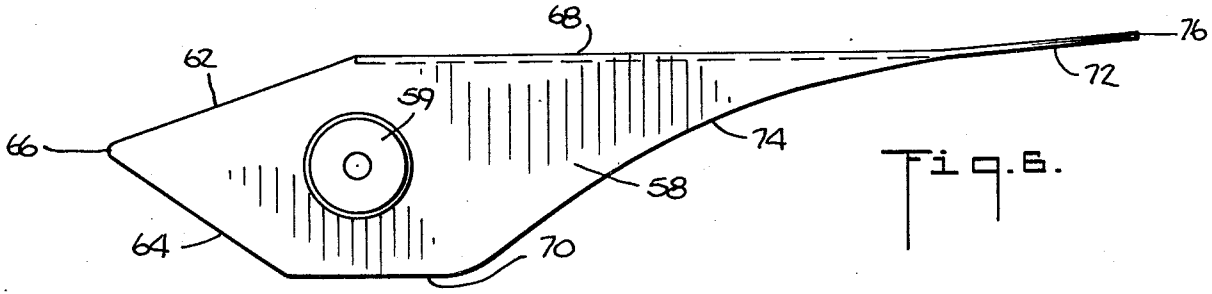
FIG. 6 is a side elevation of one bottom former member according to the invention.
Figure 7:
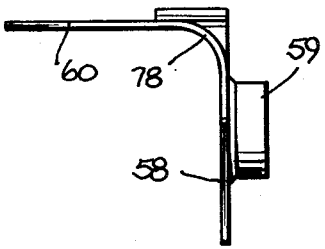
FIG. 7 is a front elevation of one bottom former member.

The configuration of the bottom formers 52 and 54 according to the present invention are shown in detail in FIGS. 3 to 7. Each plate-like bottom former has a vertical side portion 58 and a horizontal top portion 60 connected by a 90° bend or fold line 78. The vertical side portion 58 is best seen in FIGS. 4 and 6, and includes an upper straight front edge 62 which extends upwardly rearwardly and a lower straight front edge 64 which extends downwardly rearwardly, said upper front edge and lower front edge meet to form a pointed front 66. An upper edge 68 extends substantially horizontally, and a forward lower edge portion 70 also extends substantially horizontally. A rearward lower edge portion 72 extends substantially horizontally and a medial lower edge portion 74 is upwardly arcuately bowed and connects the forward lower edge portion 70 with the rearward lower edge portion 72. The rear edge 76 of the vertical side portion 58 has a length which is equal to the plate thickness of the bottom former. The vertical side portion 58 is provided with a boss 59 for receiving the clamping screws 50.

As best seeen in FIGS. 4 and 5 the horizontal top portion 60, which is connected to the vertical side portion 58 along the bend line 78, has a straight outer edge 80. An inner edge indicated generally at 84 has a series of interconnected portions extending in the direction from the front to the rear of the bottom former including a first elongated portion 88 extending inwardly and rearwardly with a very slight outwardly directed bow, a straight short second portion 90 extending parallel to the outer edge 80, a straight third portion 92 extending perpendicular to the outer edge 80, a fourth portion 94 extending parallel to the outer edge 80, and a rear edge 96 extending perpendicular to the outer edge 80.

A comparison of the bottom formers constructed in accordance with the concepts of the present invention, as compared to prior art bottom formers, is illustrated by comparing FIGS. 3 and 10. Thus, it will be seen that the inner edge of the horizontal top portion of the bottom formers 40 and 42 is substantially different from that of the bottom formers according to the present invention. That is, the inner edge 84 of the bottom formers of the present invention are provided with a first elongated portion 88 which extends inwardly and rearwardly with a very slight outwardly directed bow and a relatively short straight second portion 90 extending parallel to the outer ege 80, whereas on the contrary the inner edge 98 of the prior art bottom formers 40 and 42 is elongated and extends parallel to the outer edge 100, thereof. This is an important aspect of the present invention as it provides a substantially larger space 102, as compared to the prior art space 104, between the two bottom forming members for the escape of air which occurs as the upper layer 24 of the bag blank is being folded back on itself along the score line 30.

Another comparison of the construction of the bottom formers of the prior art wth the bottom formers according to the present invention is illustrated by comparing FIGS. 6 and 9. That is, the bottom former of the present invention is provided with a vertical side portion 58 having a upper straight front edge 62 extending upwardly rearwardly and a lower straight front edge 64 extending downwardly rearwardly, which meet to form a pointed front 66, whereas on the contrary the prior art bottom formers are provided with a vertical side portion 106 having an elongated blunt front edge 108. Next, the vertical side portion 58 of the present invention is provided with a medial lower edge portion 74 that is upwardly, arcuately bowed whereas the prior art provides a straight medial lower edge portion 110. Consequently, before the opening cylinder finger 38 releases the top part of the bag blank or tube, the bottom formers in accordance with the present invention contact the open tube. This causes the open tube to break on the first and second lines 30, 32 at the same time that the bottom is being formed in a rolling motion, instead of a break-down motion as occurred with the prior art designs. Thus, there is complete control of the bottom formation at all times.

It will thus be seen that the present invention does indeed provide an improved former which provides a superior quality bottom formation, which requires substantially less adjustment, with which the machine speed may be increased from about 50 to 75 bags per minute, and with which quality bags may be produced at a substantially lower machine speed for start-up operation.

Although a particular embodiment of the invention is herein disclosed for purposes of explanation, various modifications thereof, after study of this specification, will be apparent to those skilled in the art to which the invention pertains.

What is claimed and desired to be secured by Letters Patent is:

1. A bottom forming device for a bag forming machine comprising a pair of bottom formers, each bottom former being of plate-like construction and having, with respect to the path of travel of a bag bottom during the forming thereof, a vertical side portion and a horizontal top portion connected along a fold line, said horizontal top portion having an inner edge which has an elongated portion extending inwardly and rearwardly, said vertical side portion extending a substantial distance forwardly of said horizontal top portion.

2. A bottom forming device for a bag forming machine comprising a pair of bottom formers, each bottom former being of plate-like construction and having, with respect to the path of travel of a bag bottom during the forming thereof, a vertical side portion and a horizontal top portion connected along a fold line, said vertical side portion extending a substantial distance forwardly of said horizontal top portion, said vertical side portion having an upper front edge which extends upwardly and rearwardly, a lower front edge which extends downwardly and rearwardly, and said upper front edge and said lower front edge meeting to form a pointed front edge.

3. A bottom forming device for a bag forming machine according to claim 2 wherein said vertical side portion has a medial lower edge portion that is upwardly arcuately bowed.

4. A bottom forming device for a bag forming machine comprising a pair of bottom formers, each bottom former being of plate-like construction and having, with respect to the path of travel of a bag bottom during the forming thereof, a vertical side portion and a horizontal top portion connected along a fold line, said vertical side portion extending a substantial distance forwardly of said horizontal top portion, said vertical side portion having an upper front edge which extends upwardly and rearwardly, a lower front edge which extends downwardly and rearwardly, and said upper front edge and said lower front edge meeting to form a pointed front edge; said horizontal top portion having an inner edge which has an elongated portion extending inwardly and rearwardly, said pair of bottom formers being adjustably mounted in parallel on a pair of brackets with their horizontal top portions being in a common plane and with their inner edge portions facing each other.

5. A bottom forming device for a bag forming machine according to claim 4 further comprising at least one guide finger mounted to extend in the space between said inner edge portions.

6. A bottom forming device for a bag forming machine comprising a pair of bottom formers, each bottom former being of thin plate-like construction and having, with respect to the path of travel of a bag bottom during the forming thereof, a vertical side portion and a horizontal top portion connected along a fold line;

said horizontal top portion having a straight outer edge, and an inner edge having a series of interconnected portions extending from the front to the rear of the bottom former including a first straight elongated portion extending inwardly and rearwardly with a very slight outwardly directed bow, a straight short second portion extending parallel to said outer edge, a straight third portion extending perpendicular to said outer edge, a straight fourth portion extending parallel to said outer edge, and a rear portion extending perpendicular to said outer edge.

7. A bottom forming device for a bag forming machine according to claim 6 wherein, said vertical side portion has an upper straight front edge which extends upwardly rearwardly, a lower straight front edge which extends downwardly rearwardly, said upper front edge and lower front edge meeting to form a pointed front, an upper edge which extends substantially horizontally, a forward lower edge portion that extends substantially horizontally, a rearward lower edge portion that extends substantially horizontally, a medial lower edge portion that is upwardly arcuately bowed and connects the forward lower edge portion with the rearward lower edge portion, and a rear edge of a length equal to the plate thickness of the bottom former.

8. A bottom forming device for a bag forming machine comprising a pair of substantially identical bottom formers, each bottom former being of thin plate-like construction and having a peripheral contour as shown in FIG. 4.

* * * * *